US007895696B2

(12) United States Patent
Belmonte

(10) Patent No.: US 7,895,696 B2
(45) Date of Patent: Mar. 1, 2011

(54) CONVERTIBLE IMPLEMENT

(76) Inventor: Albert Belmonte, North Ridgeville, OH (US)

( * ) Notice: Subject to any disclaimer, the term of this patent is extended or adjusted under 35 U.S.C. 154(b) by 758 days.

(21) Appl. No.: 11/789,863

(22) Filed: Apr. 25, 2007

(65) Prior Publication Data

US 2008/0263798 A1 Oct. 30, 2008

(51) Int. Cl.
*A46B 15/00* (2006.01)

(52) U.S. Cl. ..... 15/106; 15/105; 15/202

(58) Field of Classification Search ..... 15/106, 15/201, 172
See application file for complete search history.

(56) References Cited

U.S. PATENT DOCUMENTS

| | | | | |
|---|---|---|---|---|
| 2,384,029 | A * | 9/1945 | Hawkins | 15/201 |
| 2,629,125 | A | 2/1953 | Ferguson | |
| 2,677,841 | A | 5/1954 | Tetzlaff | |
| 2,787,016 | A | 4/1957 | Carpenter | |
| 3,536,285 | A | 10/1970 | Vaughn | |
| 4,025,980 | A | 5/1977 | Neil | |
| 4,134,171 | A | 1/1979 | Love | |
| 4,469,223 | A | 9/1984 | Smith | |
| 4,497,417 | A * | 2/1985 | Tabet | 220/772 |
| 5,778,479 | A * | 7/1998 | Raia | 15/202 |
| 6,195,830 | B1 * | 3/2001 | Bruschi | 15/143.1 |
| 6,510,578 | B1 * | 1/2003 | Cyr et al. | 15/176.6 |
| 6,685,048 | B1 * | 2/2004 | Ranzoni et al. | 220/759 |
| 6,739,021 | B2 | 5/2004 | Rabello | |
| 2003/0233719 | A1 | 12/2003 | Wolfinger | |

FOREIGN PATENT DOCUMENTS

DE 19742286 A1 * 4/1998

* cited by examiner

*Primary Examiner* — Monica S Carter
*Assistant Examiner* — Stephanie Newton
(74) *Attorney, Agent, or Firm* — McDonald Hopkins LLC

(57) ABSTRACT

A convertible implement is provided having a first implement with a first operable head connected to a first handle. The first implement is removably connected to a second implement having a second operable head connected to a second handle.

11 Claims, 9 Drawing Sheets

CONVERTIBLE IMPLEMENT

FIELD OF THE INVENTION

This invention relates to a hand-held implement and, more particularly, to a convertible hand-held implement.

BACKGROUND OF THE INVENTION

Hand-held implements are used for numerous applications. For example, paintbrushes are utilized in the application of coating compositions, such as paint or varnish. Paintbrushes generally include a handle with an end upon which a plurality of bristles are attached. The manufacture of paintbrushes typically includes securing a ferrule to the handle for providing an open end to accept the bristles. The bristles are fitted into the open end of the ferrule and secured in place by an adhesive.

It is common practice to utilize multiple brushes of varying widths to accommodate different painting surfaces, such as walls, trellises, furniture, and sashes. This practice necessitates the purchase and transport of numerous paintbrushes by the painter, resulting in undesirable expense and inconvenience, as when the paintwork is performed on a ladder or in a remote location. Attempts have been made to provide convertible implement capable of performing different types of paintwork; however, such attempts have suffered from several deficiencies. Typically, such convertible paintbrushes require the attachment and/or detachment of bristle heads with a screw or more complicated device. Further, many of these paintbrushes require the painter to remove the handle and insert it into another position or bristle head before using it.

Accordingly, such paintbrushes require several additional parts and tools that make assembly and use difficult, and often result in streaky or otherwise poor application of coatings. Therefore, it would be desirable to provide a convertible implement capable of easy assembly without additional tools. It is also desirable to provide a convertible implement capable of separating into at least two functional paintbrushes, without requiring the attachment or repositioning of the handle. It is also desirable to provide a convertible implement that is capable of applying coatings without streaks.

Additional information will be set forth in the description that follows, which will be obvious in part from the description or may be learned by practice of the invention.

SUMMARY OF THE INVENTION

A convertible implement having a first implement with a first operable head connected to a first handle. The first implement is removably connected to a second implement having a second operable head connected to a second handle.

Also provided is a convertible implement having a first paintbrush with a first bristle head connected to a first handle. The first paintbrush is removably connected to a second paintbrush having a second bristle head connected to a second handle.

Also provided is a convertible implement having a first paintbrush with a first bristle head connected to a first handle. The first paintbrush is separably connected to a second paintbrush having a second bristle head connected to a second handle.

DESCRIPTION OF THE DRAWINGS

Operation of the invention may be better understood by reference to the following detailed description taken in connection with the following illustrations, wherein.

DETAILED DESCRIPTION

While the present invention is described with reference to the embodiments described herein, it should be clear that the present invention should not be limited to such embodiments. Therefore, the description of the embodiments herein is illustrative of the present invention and should not limit the scope of the invention as claimed.

Figure 1A:
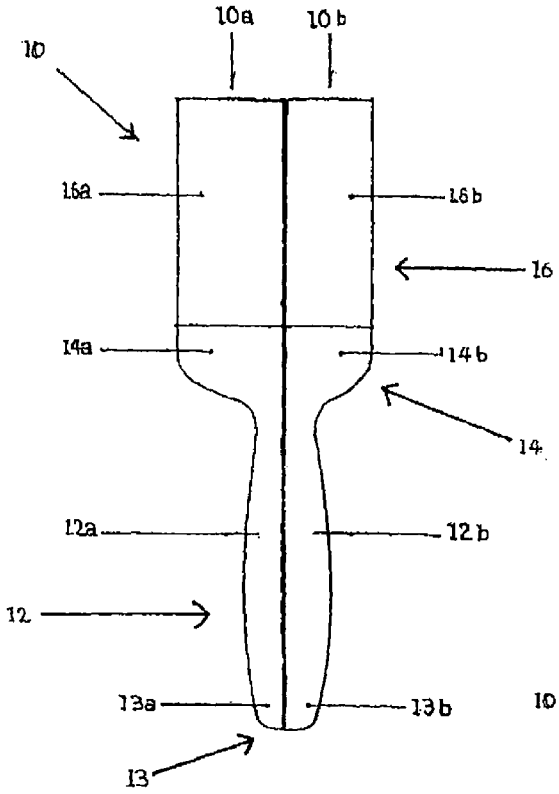
FIG. 1A is a perspective view of the convertible implement according to one embodiment of the present invention.
Figure 1B:
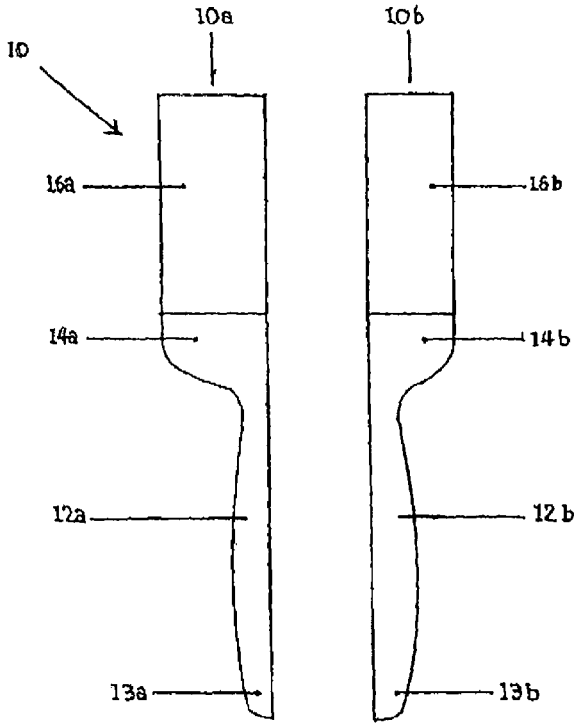
FIG. 1B illustrates the convertible implement of FIG. 1A in the separated configuration.

Reference will now be made in detail to the embodiments of the invention as illustrated in the accompanying figures. Embodiments of a convertible implement 10 are shown in FIGS. 1 through 13. As shown in FIGS. 1A-B, the convertible implement 10 generally has a first implement 10*a* removably connected to a second implement 10*b*. Each implement 10*a,b* has a handle 12*a,b* with a proximal end 13*a,b* and a distal end 14*a,b*. The distal end 14*a,b* is connected to an operable implement head 16*a,b*. As shown in FIG. 1A, the implements 10*a,b* are removably connected to form a convertible implement 10 with a handle 12 having a proximal end 13 and a distal end 14, and an operable implement head 16.

Figure 2A:
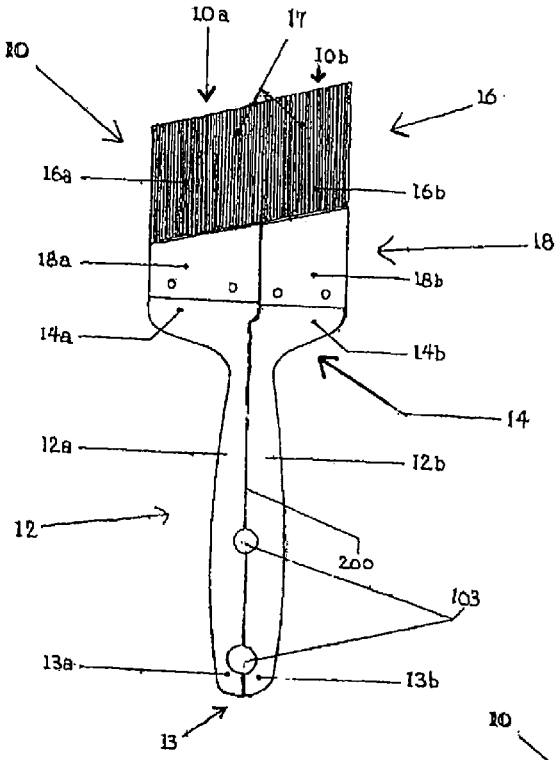
FIG. 2A is a perspective view of the convertible implement according to one embodiment of the present invention.

In one illustrative embodiment, as shown in FIG. 2A, the convertible implement 10 may be a paintbrush. The convertible implement 10 generally has a first paintbrush 10*a* removably connected to a second paintbrush 10*b*.

Figure 2B:
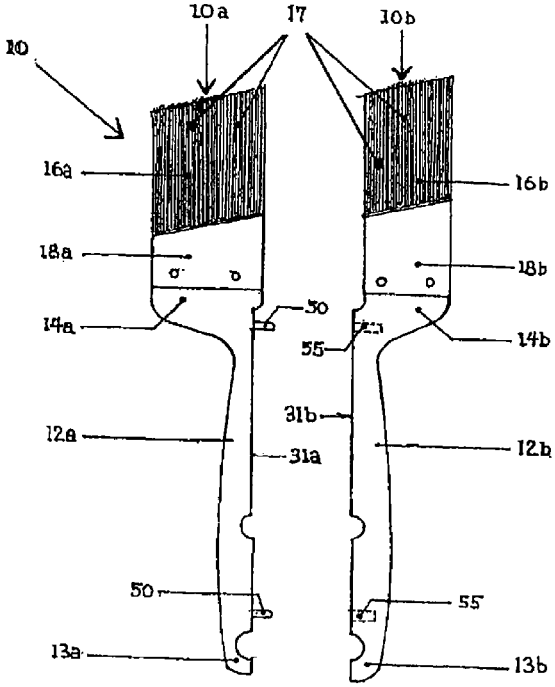
FIG. 2B illustrates the convertible implement of FIG. 2A in the separated configuration.

As shown in FIGS. 2A and 2B, each paintbrush 10*a,b* has a handle 12*a,b* with a proximal end 13*a,b* and a distal end 14*a,b*. The distal end 14*a,b* is engaged with a bristle head 16*a,b* and, in some embodiments, a ferrule 18*a,b*. As shown in FIG. 2A, the paintbrushes 10*a,b* are removably connected to form a convertible implement 10 with a handle 12 having a proximal end 13 and a distal end 14, a bristle head 16, and a ferrule 18.

The handles 12*a,b* may be made from any material such as wood, plastic, metal, composites, rubber, and the like, and coatings may also be applied. In addition, the handle 12 and handles 12*a,b* may be shaped to provide an ergonomic handgrip. As shown in FIG. 2A, the handles 12*a,b* may have substantially symmetrical widths. It is to be understood, however, that the handles 12*a,b* may have asymmetrical widths. In addition, the handles 12*a,b* may be modified to facilitate separation, such as expanding the width, providing tabs or grips, and the like. It is also understood that the handle 12 and handles 12*a,b* may have hang holes 103/103*a,b*.

The bristle heads 16*a,b* may have bristles 17 comprised of any natural or synthetic material such as hog-bristles, horsehair, squirrel hair, ox hair, badger hair, camel hair, sable, dog hair, nylon, polyester, synthetic hog-bristle, and mixtures thereof. It is also understood that the bristle heads 16*a,b* may have any thickness and shape such as chiseled, square, angled, thin, flat, wall, and oval heads and, alternatively, may be foam rather than bristles 17. Ferrules 18*a,b* may also be utilized to align the bristles 17 and assist in securing the bristle heads 16*a,b* and handle 12*a,b* together. The ferrules 18*a,b* may be made from any material such as plastic, leather, stainless steel, copper, brass, nickel-plated steel, tin, rust-resistant materials, and the like.

Figure 3A:
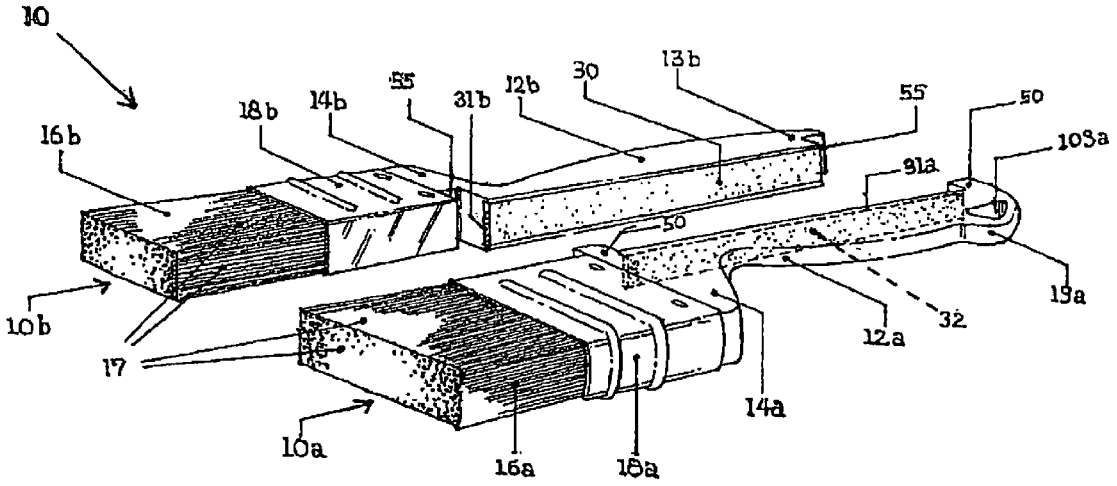
FIG. 3A is a perspective view of another embodiment of the present invention.
Figure 3B:
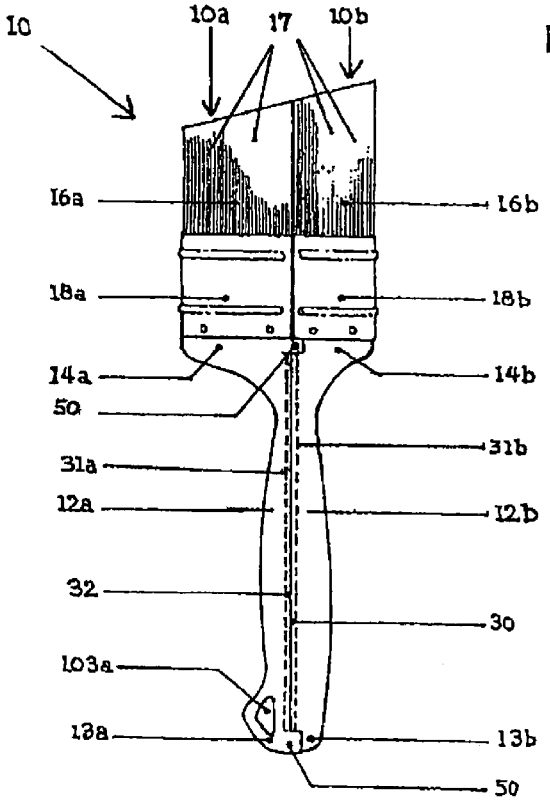
FIG. 3B is a frontal view of the embodiment of FIG. 3A.
Figure 3C:
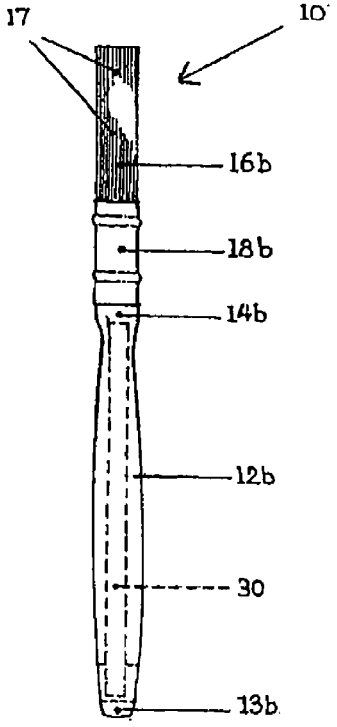
FIG. 3C is a side view of FIG. 3B.

In an embodiment as shown in FIGS. 3A-C, the paintbrushes 10*a,b* are removably connected with a magnet 30. As shown in FIG. 3B, the handles 12*a,b* each may have a substantially coplanar inner wall 31*a,b*. The magnet 30 may be secured to the inner wall 31*b*, and a second magnet 32, metallic material, or any other material capable of being attracted by a magnet (hereinafter referred to as "magnet 32") may be secured to the inner wall 31*a*, and vice versa. In some embodiments, the magnet 30 and/or magnet 32 may be permanent magnets.

As shown in FIG. 3A, the magnets 30, 32 may be in the form of a strip that extends substantially the entire length of the inner walls 31*a,b*. In addition, the inner walls 31*a,b* may be recessed within the handles 12*a,b*, thereby allowing the magnets 30, 32 to be embedded within handles 12*a,b*, respectively. In another embodiment (not shown), the magnets 30, 32 may extend substantially the entire length of the inner walls 31*a,b*, as well as the ferrules 18*a,b*.

However, the magnets 30, 32 should not be deemed as limited to any specific shape or position, as one or more magnets can be positioned at any point in, on, or around the handles 12*a,b* and/or the ferrules 18*a,b*. One of ordinary skill in the art will appreciate the use of various configurations and positions for the magnets 30, 32. The magnets 30, 32 must only be positioned so that the magnetic field exerted by the magnets 30, 32 is sufficiently strong to removably connect the paintbrushes 10*a,b* so as to provide streak-free painting when the paintbrushes 10*a,b* are combined. It is also understood that the magnets 30, 32 may be moldingly secured to or moldingly embedded in the handles 12*a,b* and/or the ferrules 18*a,b* or may be secured with an adhesive, screw, or the like.

Figure 4A:
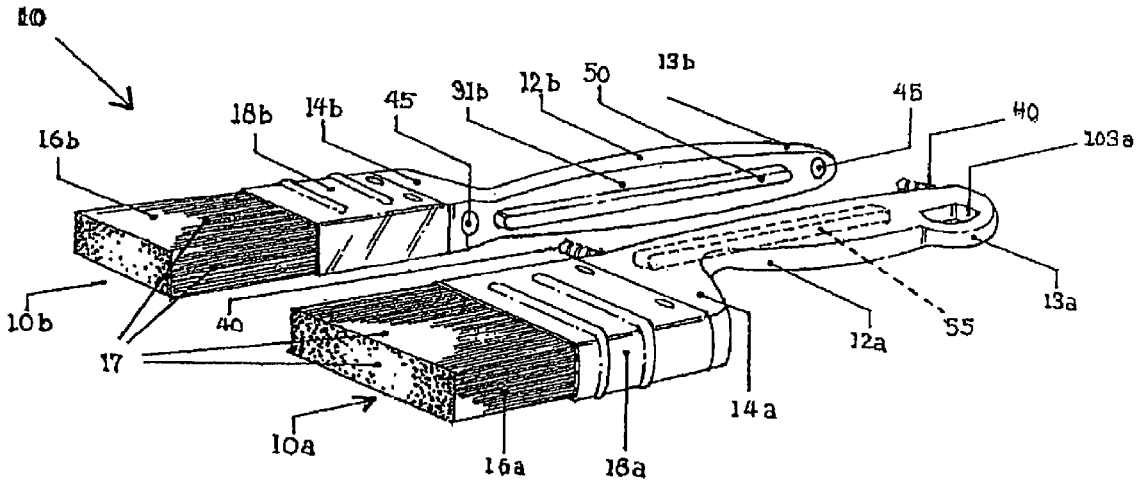
FIG. 4A is a perspective view of another embodiment of the present invention.
Figure 4B:
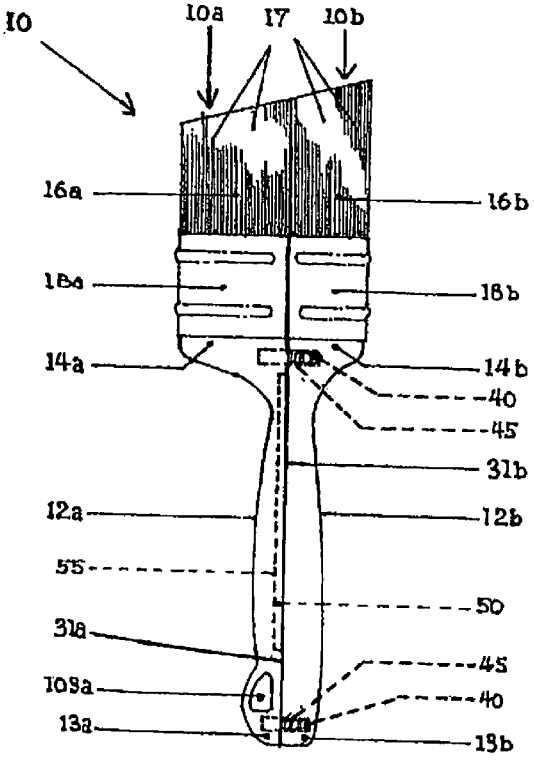
FIG. 4B is a frontal view of the embodiment of FIG. 4A.
Figure 4C:
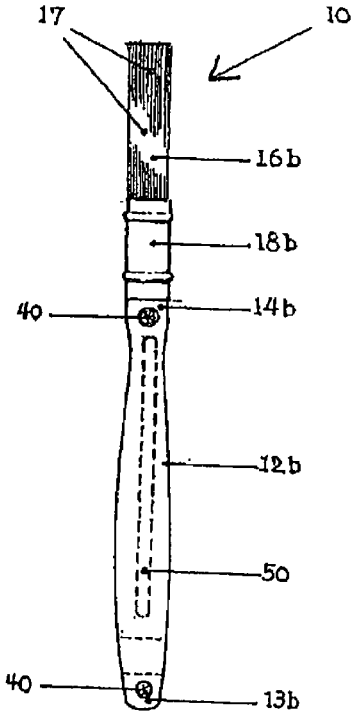
FIG. 4C is a side view of FIG. 4B.

In another embodiment as shown in FIGS. 4A-C, one or more gripper members 40 may be provided to removably connect the paintbrushes 10*a,b*. The gripper member 40 may be secured to handle 12*a* and extend substantially perpendicularly outward from the inner wall 31*a*. The gripper member 40 may have any shape such as ribbed, barbed, or riveted protrusions capable of removably engaging a receiver 45 that may be defined by a cavity in handle 12*b*. The gripper member 40 may be any material, such as wood, metal, plastic, or composites, that allows the gripper member 40 to be inserted and removed from the receiver 45 without damage to or distortion of its retaining shape. It is also to be understood that one or more gripper members 40 and receivers 45 may be provided in any combination along the handles 12*a,b* and/or the ferrules 18*a,b*. The gripper members 40 may be secured to the paintbrushes 10*a,b* in a variety of ways, such as screwing, molding, gluing, and the like. In yet another embodiment, gripper members 40 may be a screw and receivers 45 may be defined by threaded cavities capable of threadingly engaging the screws. In some embodiments, the magnets 30, 32 may be used in combination with the gripper member 40 and the receiver 45.

However, the paintbrushes 10*a,b* should not be deemed as limited to any specific configuration in order to removably connect the paintbrushes 10*a,b* to form the convertible implement 10. One of ordinary skill in the art will appreciate the use of various configurations to removably connect the paintbrushes 10*a,b*. Illustrative, non-limiting examples may include Velcro, bayonet connectors, snap fasteners such as snap buttons, dovetail connections, tongue and groove connections, mortise and tenon connections, and/or a deformable collar or sleeve that may slide over the handles 12*a,b*.

In addition, one or more alignment guides 50 may be provided on the paintbrushes 10*a,b*. In one embodiment as shown in FIG. 2B, the guide 50 may be a substantially cylindrical projection extending substantially perpendicularly outward from the inner wall 31*a* that is capable of engaging a receiver 55. The receiver 55 may be defined by a recess or cavity in the second handle portion 12*b*, having substantially the same shape as the guide 50 for alignment of the guide 50 therein. The guide 50 facilitates proper alignment of the paintbrushes 10*a,b* when combining to form the convertible implement 10 and prevents dislodgement and/or rotation of the paintbrushes 10*a,b* during use.

In another embodiment as shown in FIG. 3A, the guide 50 may be a substantially rectangular projection extending substantially perpendicularly outward from the inner wall 31*a* to engage a receiver 55 in handle 12*b*. In yet another embodiment as shown in FIG. 4A, the guide 50 and the receiver 55 may have a tongue and groove configuration. The guide (tongue) 50 may be an elongated, substantially rectangular projection extending substantially perpendicularly outward from the inner wall 31*b* that is capable of engaging a receiver (groove) 55 in the inner wall 31*a*. It is to be understood, however, that the guide 50 and the receiver 55 should not be deemed as limited to any specific shape, quantity, or position on the paintbrushes 10*a,b*. One of ordinary skill in the art will appreciate the use of various shapes, quantities, and positions for the guide 50 and the receiver 55. In addition, it is to be understood that any guide 50 and receiver 55 may be used in any combination with any configuration for removably connecting the handles 12*a,b*. Further, guide 50 may be of any material, and in some embodiments it may be the same material as the handles 12*a,b*.

In yet another embodiment, the convertible implement 10 may also be capable of removably connecting bristle heads 16*a,b* to the handles 12*a,b*. As shown in FIGS. 5A-C and 6, the bristle heads 16*a,b* may be secured to a base 60*a,b* having a substantially rectangular shape. Ferrules 18*a,b* may be provided to facilitate securing the bristle heads 16*a,b* to the bases 60*a,b* and to maintain alignment of the bristles 17.

Figure 5A:
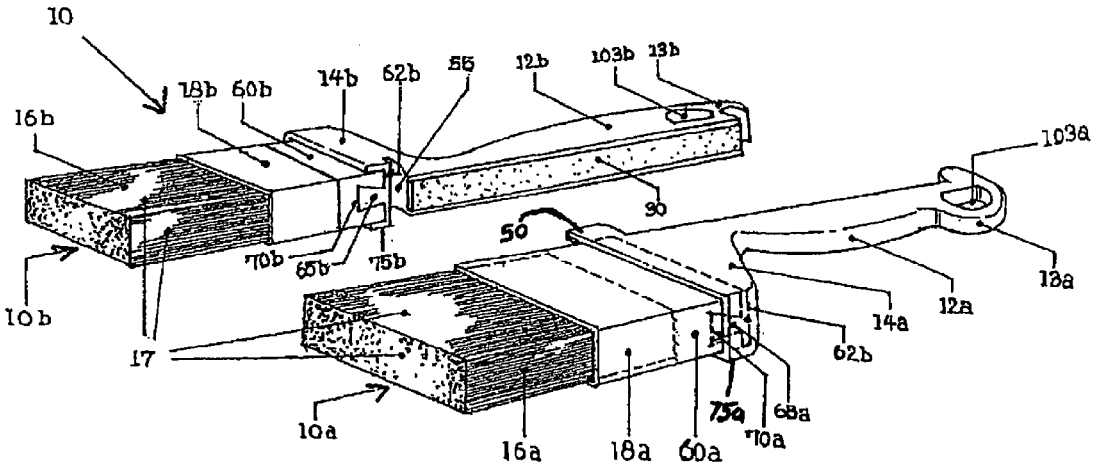
FIG. 5A is a perspective view of another embodiment of the present invention.
Figure 5B:
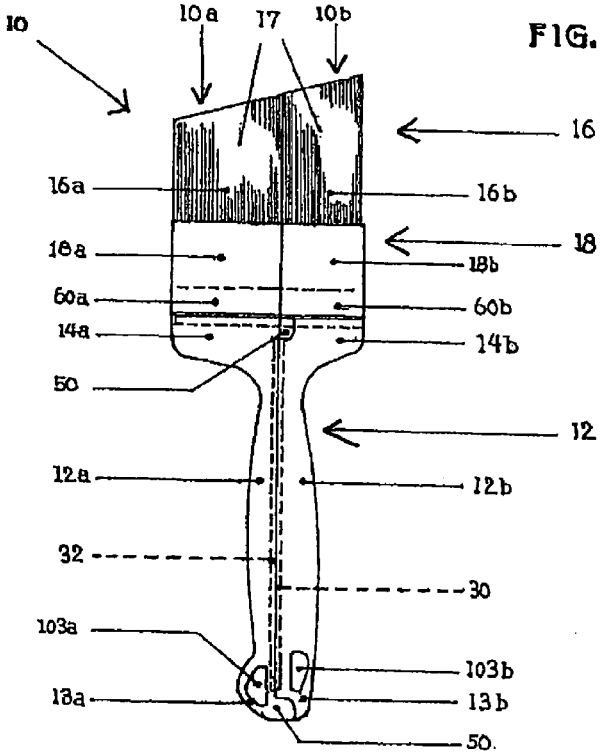
FIG. 5B is a frontal view of the embodiment of FIG. 5A.
Figure 5C:
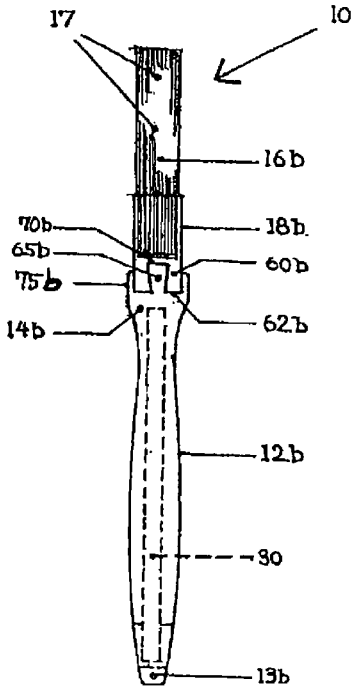
FIG. 5C is a side view of FIG. 5B.
Figure 6:
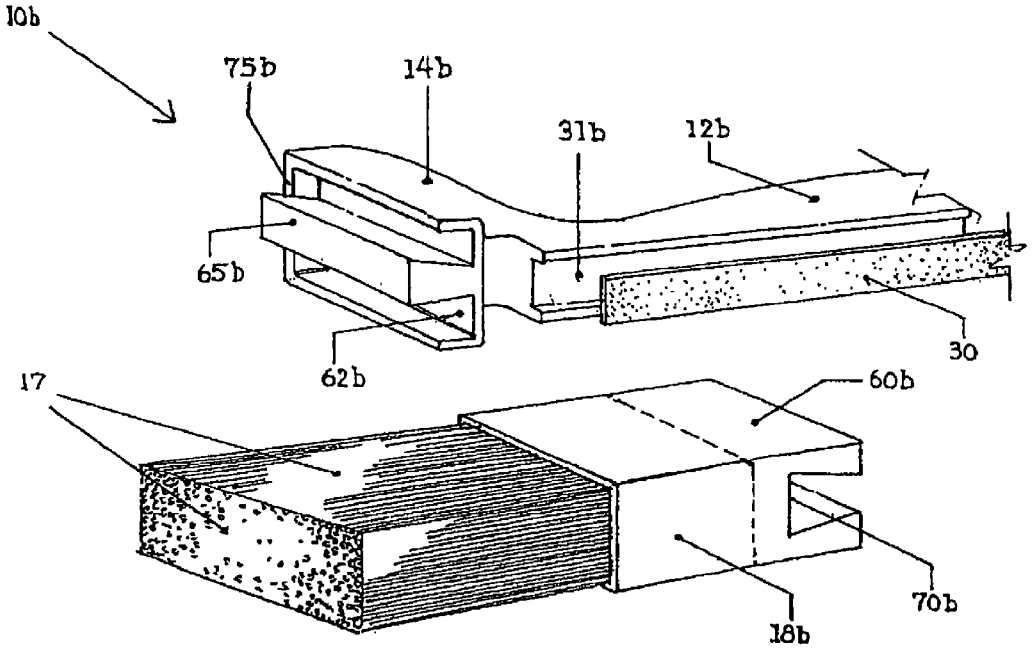
FIG. 6 is an exploded view of another embodiment of FIG. 5A.

In one embodiment, as best shown in FIGS. 5A and 6, the bases 60*a,b* may be removably connected to the distal ends 14*a,b* with a sliding dovetail configuration. The distal ends 14*a,b* may be provided with a substantially coplanar surface 62*a,b* that is substantially perpendicular to the longitudinal axis of the handles 12*a,b*. An elongated substantially trapezoidal projection (tail) 65*a,b* extends substantially perpendicularly outward from the surface 62*a,b*. Grooves 70*a,b* are provided in the bases 60*a,b* that are defined by a cavity in the bases 60*a,b* and that are capable of slidingly engaging the tail 65*a,b* to removably connect the base 60*a,b* to the distal ends 14*a,b*. A raised perimeter 75*a,b* with an open end may be provided to assist in removably connecting the bristle segments 16*a,b*.

It is to be understood that either or both bristle heads 16*a,b* may removably connected and that, in some embodiments, the base may be provided with the tail 65*a,b* and the distal ends 14*a,b* with the groove 70. In other embodiments (not shown), the bristle heads 16*a,b* may be removably connected and/or aligned as described above for removably connecting the handles 12*a,b*. However, the convertible implement 10 should not be deemed as limited to any specific configuration for removably connecting the bristle heads 16*a,b* to the handles 12*a,b*. One of ordinary skill in the art will appreciate the use of various configurations to removably connect the bristle heads 16*a,b* to the handles 12*a,b*.

Figure 7:
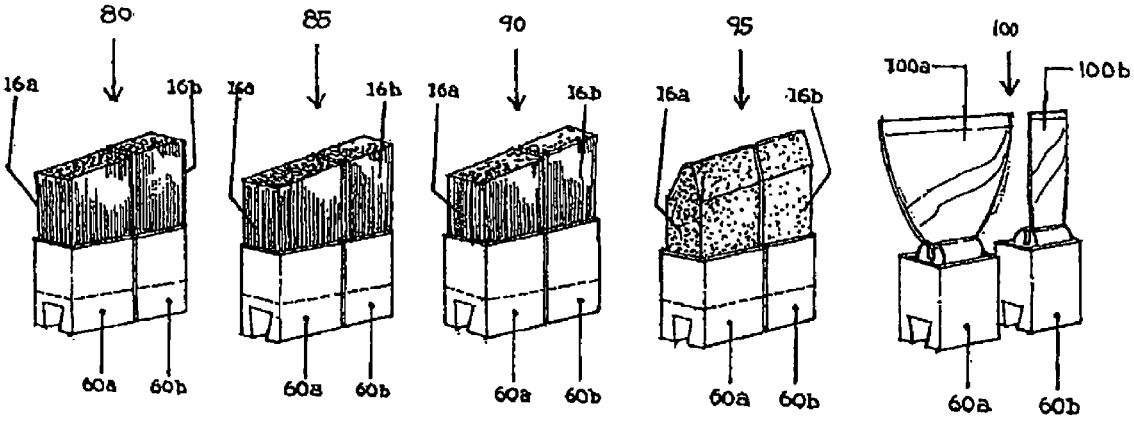
FIG. 7 illustrates operable implement heads capable of being used with the present invention.

FIG. 7 provides illustrative examples of the bristle heads 16*a,b* and other implement heads that may be removably connected to the handles 12*a,b*, such as a horse hair set 80, a synthetic set 85, a disposable set 90, a foam set 95, and a scraper set 100 with scrapers 100*a* and 100*b*. It is to be understood that the convertible implement 10 may have a bristle head 16 of any size and may be separated into paintbrushes 10*a,b* with bristle heads 16*a,b* of any width. Standard bristle head widths generally include 1", 1½", 2", 2½", 3", 3½", 4", and 6" widths. Generally, bristle head widths from 1"-2" are used for small trim purposes; widths from 2"-3" are used for cupboards, doors, and fences; and widths greater than 3" are used for larger surfaces.

Accordingly, the paintbrushes 10*a,b* may have bristle heads 16*a,b* of any width, standard or nonstandard. In one illustrative embodiment, the bristle head 16 may have a 3½" width. Accordingly, paintbrush 10*a* may be a 1½" bristle head 16*a* and paintbrush 10*b* may have a 2" bristle head 16*b*. In another illustrative embodiment, the bristle head 16 may have a width of 4" and the paintbrushes 10*a,b* may be comprised of two 2" bristle heads 16*a,b* or a 2½" bristle head 16*a* and a 1½" bristle head 16*b*. Accordingly, it is to be understood that a painter may combine bristle heads 16*a,b* to form a bristle head 16 of any desired width. In some embodiments, a painter may configure the convertible implement 10 with bristle heads 16*a,b* that are capable of applying both oil and latex paints.

Figure 8:
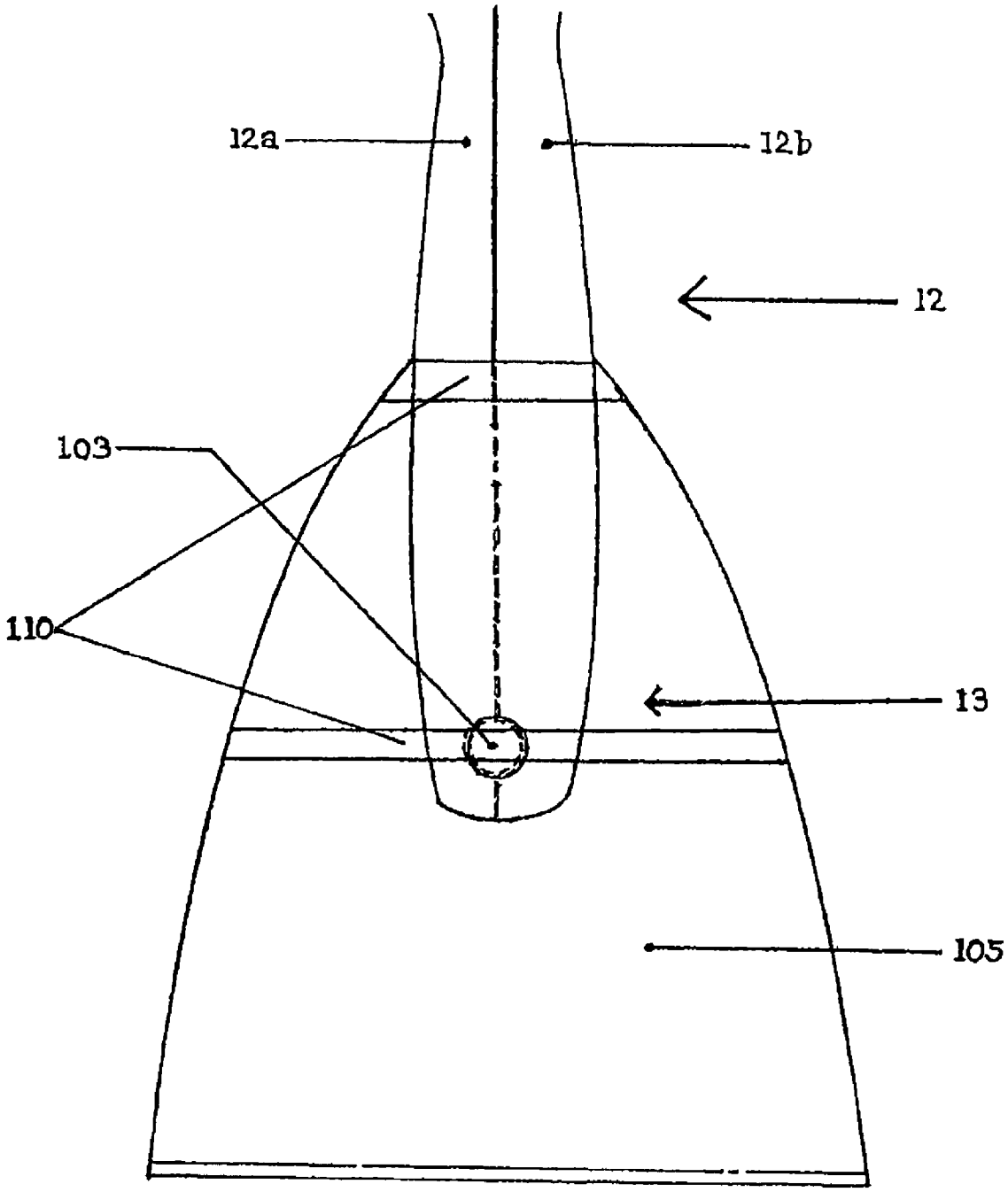
FIG. 8 illustrates a scraper capable of being used with the present invention.
Figure 9:
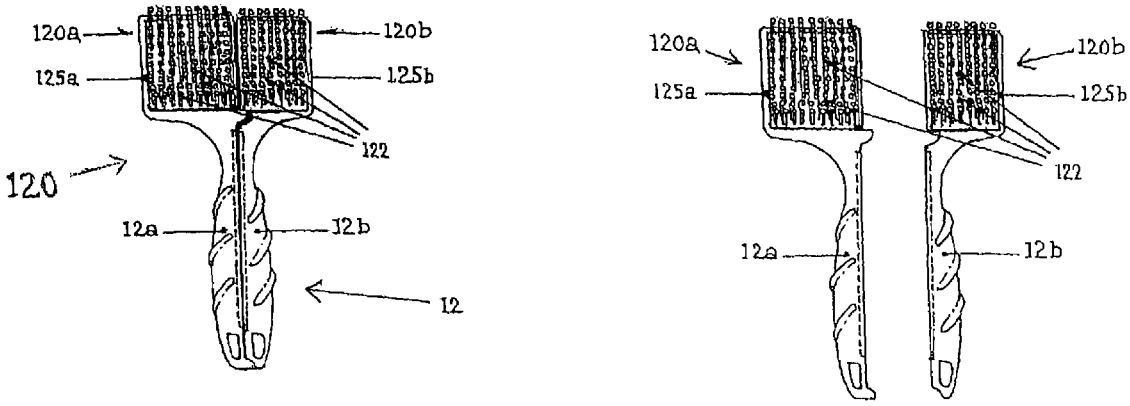
FIG. 9 illustrates a convertible implement in another embodiment of the present invention.

In another embodiment as shown in FIG. 8, a scraper 105 or other tool may be connected to the proximal end 13 of the convertible implement 10. Although it is shown connected to the convertible implement 10, it is to be understood that the handles 12*a,b* may each be configured to attach tools, such as a scraper 105. The scraper 105 may be connected with attachment bands 110, magnets, screws, clips, and the like.

Turning to the convertible implement 10, an example of how to use the convertible implement 10 as illustrated in FIGS. 2-7 is set forth below. As shown in FIGS. 3A-B, the convertible implement 10 is provided with magnets 30, 32 and is capable of being used to apply a coating composition to a surface without streaking. When application of a coating composition to, for example, a narrower surface is desired, paintbrushes 10*a,b* may be quickly detached by simply applying a force greater than the force exerted by the magnetic field of the magnets 30, 32. Accordingly, either or both paintbrushes 10*a,b* can be used to coat a surface without the need for additional tooling or reconfiguration.

When application of a coating composition to a larger surface is desired, the paintbrushes 10*a,b* may be combined to form the convertible implement 10. This is achieved by simply placing magnets 30, 32 in close proximity to allow the magnetic field to removably connect the paintbrushes 10*a,b*. Proper alignment may be facilitated by an alignment guide 50, which engages the receiving member 55. In addition, the guide 50 also provides additional stability during use. Accordingly, the paintbrushes 10*a,b* are properly aligned to allow coating of a surface with the convertible implement 10 without streaking and without rotation or disengagement of the paintbrushes 10*a,b*. In one embodiment as shown in FIGS. 3B-C, the convertible implement 10 may have the appearance and feel of a conventional paintbrush when the paintbrushes 10*a,b* are combined.

Similarly, as shown in FIGS. 4A-C, the convertible implement 10, when provided with a gripper member 40, is capable of being used to apply a coating composition to a surface without streaking. The paintbrushes 10*a,b* may be quickly detached by simply applying a force greater than the force exerted by the gripper member 40 on the receiver 45.

To continue coating a larger surface, the paintbrushes 10*a,b* may be combined to form the relatively larger convertible implement 10. This is achieved by simply inserting the gripper member 40 into the receiver 45 to removably connect the paintbrushes 10*a,b*. The proper alignment is facilitated by the alignment guide 50, which engages the receiving member 55. However, where gripper members 40 are provided, the gripper members 40 can also serve to properly align the paintbrushes 10*a,b*.

The convertible implement 10 may also provide for the use of different bristle heads 16*a,b*. In the embodiment shown in FIGS. 5-6, the paintbrushes 10*a,b* are removably connected using a magnet 30, 32. As is best shown in FIGS. 5A and 6, the bristle heads may be removably connected when the paintbrushes 10*a,b* are separated, by slidingly engaging the tail 65*a,b* with the groove 70*a,b*. It is to be understood that the groove 70*a,b* may be tapered such that the groove 70*a,b* becomes narrower as the end wall 75*a,b* is reached. Accordingly, the sliding dovetail configuration allows for quick and easy changing of the brush heads without tools. Additionally, the tapered groove 70*a,b* removably connects the body 60*a,b* and the bristle heads 16*a,b* in position to allow the paintbrushes 10*a,b* to be used together as the convertible implement 10 or separately.

When application of a coating composition with a different bristle head 16*a,b* is desired, the base 60 may be quickly detached (when paintbrushes 10*a,b* are detached) by simply applying a force greater than the force exerted by the tail 65*a,b* and the groove 70*a,b* toward the opening in the raised perimeter 75*a,b*. Accordingly, another base 60*a,b* with a different bristle head 16*a,b* may be removably connected as described above.

Accordingly, the convertible implement 10 allows for easy attachment and detachment of the paintbrushes 10*a,b* to allow a painter to paint a variety of surfaces while only carrying one brush. In addition, the convertible implement 10 may allow for such modifications without requiring additional tools or repositioning of the handle 12 or handles 12*a,b*. Further, the convertible implement 10 is capable of painting surfaces without streaking.

The lack of dependence upon additional tools is especially useful in instances when paintwork is performed while the painter is on a ladder or scaffolding. In some embodiments, the magnets 30, 32 may be strong enough to removably connect the paintbrushes 10*a,b* to a metal surface while not in use. In addition, the magnets 30, 32 may provide therapeutic pain-easing and healing effects to the operator. The repetitive motions used to manipulate hand-held implements, such as paintbrushes, can adversely affect muscle tissue in the hand and arm. Magnetic therapy is believed to promote healing, reduce pain, and provide a natural, drug-free method of pain management. Accordingly, magnetic flux therapy may reduce the effects of the repetitive motions transmitted through the handle of a hand-held device and to the user of the device. Therefore, the magnets 30, 32 may be configured in or on the handles 12*a,b* to optimize flux therapy to the user. In some embodiments, magnets 30, 32 may be arranged on the handles 12*a,b* to directly contact an operator's hand.

Figure 10:
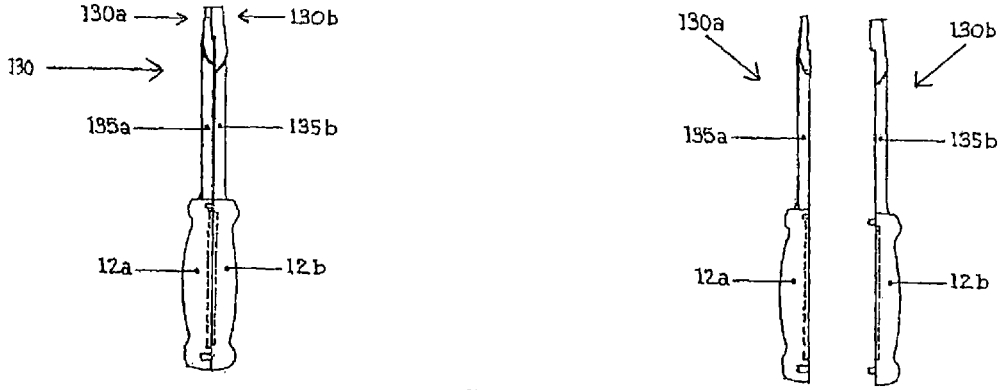
FIG. 10 illustrates a convertible implement in another embodiment of the present invention.
Figure 11:
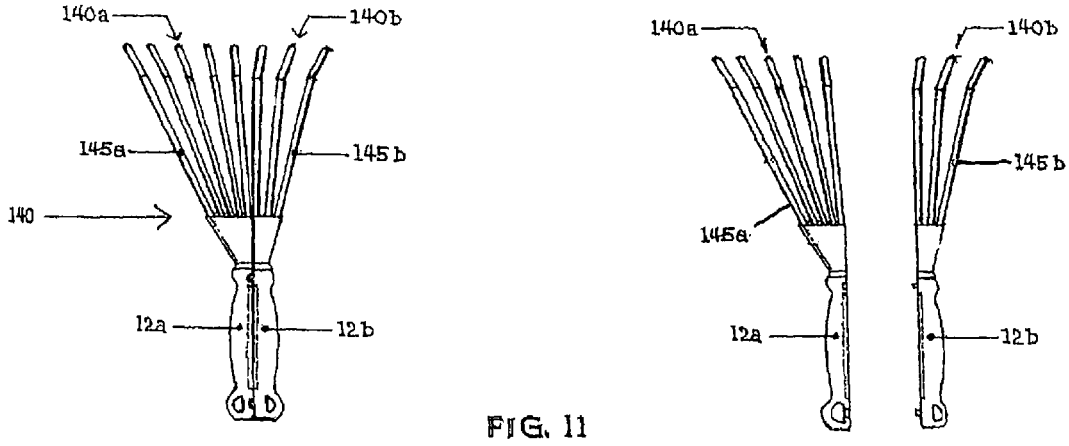
FIG. 11 illustrates a convertible implement in another embodiment of the present invention.

It is also understood that the convertible implement may be provided with other operable implement heads. In one embodiment shown in FIG. 9, a convertible implement 120 may be provided with removably connected pet hairbrushes 10*a,b* with a plurality of bristles 122. Similar to the convertible implement 10 described above, convertible implement 120 would be capable of separating into two separate hairbrushes 120*a,b* for use on different animals or on different parts of an animal that might require a smaller hairbrush. In another embodiment, as shown in FIG. 10, a convertible implement 130 may have removably connected screwdrivers 130*a,b* capable of separating for use on smaller screws. In yet another embodiment, as shown in FIG. 11, a convertible implement 140 may be provided with removably connected hand-held rakes 140*a,b* that are capable of being separated for individual use. Such a convertible implement 140 would allow a gardener, when confronted with a tight area such as a flowerbed or flowerpot, to continue gardening without having to retrieve or carry another rake.

Figure 12:
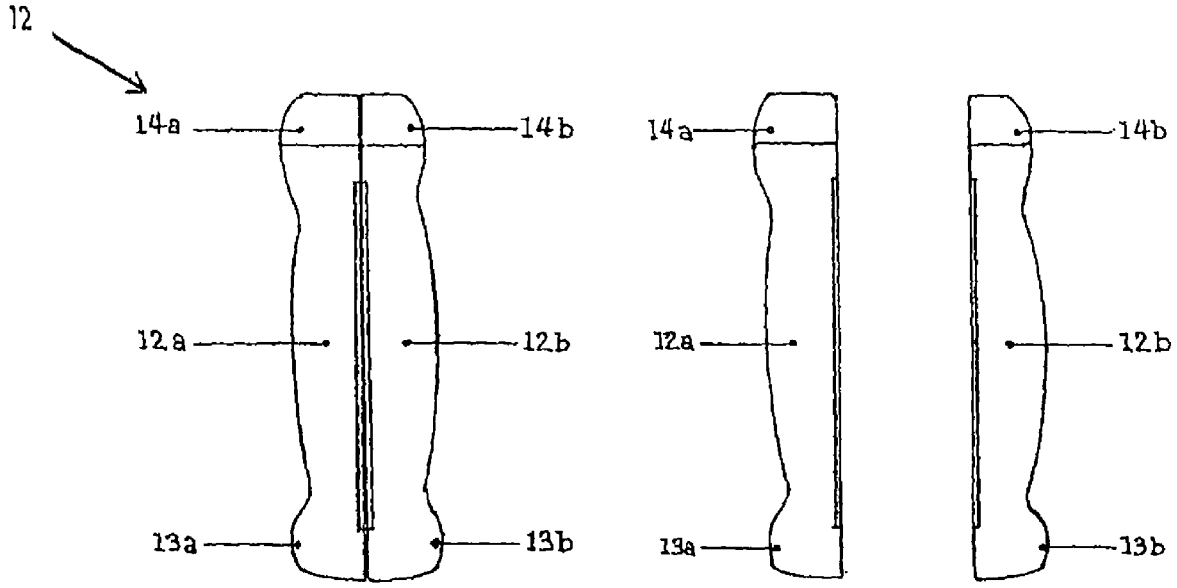
FIG. 12 illustrates a convertible implement in another embodiment of the present invention.
Figure 13:
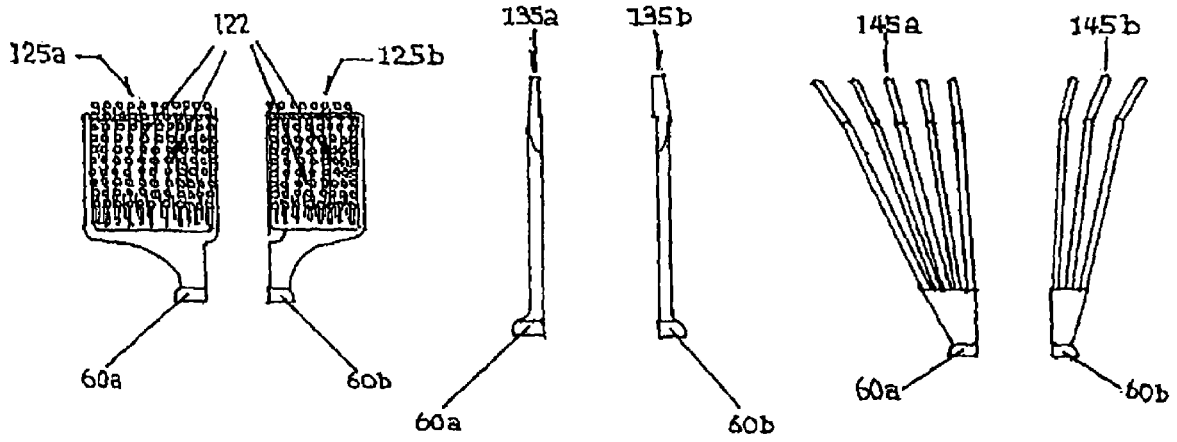
FIG. 13 illustrates operable implement heads capable of being used in the present invention.

It is also understood that, as described above with respect to the bristle heads 16*a,b*, the handles 12*a,b* may also be configured to removably connect a variety of operable implement heads as desired (as shown in FIG. 12-13), so that only one universal handle 12 would have to be purchased. As shown in FIGS. 12-13, in addition to using the handles 12*a,b* with bristle heads 16*a,b*, the same handles 12*a,b* may be used with pet hairbrush heads 125*a,b*, screwdriver heads 135*a,b*, and garden rake heads 140*a,b*, among other operative implement heads. In one embodiment, each operable head may be secured to a base 60*a,b* to facilitate connection to handles 12*a,b*, as described above. However, the implement heads should not be deemed as limited to any specific implement. One of ordinary skill in the art will appreciate the use of various implement heads for use with the convertible implement.

It is understood that in some embodiments, the convertible implement 10 may have implements 10*a,b* that are separably connected. As used herein, "separably connected" is defined as separable but not reconnectable. In one illustrative, non-limiting embodiment as shown in FIG. 2A, handles 12*a,b* may be separably connected along a perforated line 200. When desired to use separately, a force may be applied to the handles 12*a,b* sufficient to break the perforated line 200, allowing the implements 10*a,b* to be used separately. However, "separably connected" should not be deemed as limited to any specific connection. One of ordinary skill in the art will appreciate the use of various connections for "separably connecting" handles 12*a,b*. Illustrative, non-limiting examples may include adhesives, tape, and pins, among others.

The invention has been described above and, obviously, modifications and alternations will occur to others upon the reading and understanding of this specification. The claims as follows are intended to include all modifications and alterations insofar as they come within the scope of the claims or the equivalent thereof.

I claim:

1. A convertible implement comprising:

a first paintbrush having a first handle and a first bristle head connected thereto, said first handle having a first magnetic connection member connected thereto; and a second paintbrush having a second handle and a second bristle head connected thereto, said second handle having a second magnetic connection member connected thereto and wherein said second paintbrush removably connected to said first paintbrush.

2. The convertible implement of claim 1 further comprising a guide member extending outward from said first handle.

3. The convertible implement of claim 2 further comprising a receiving portion in said second handle.

4. The convertible implement of claim 3 wherein said guide member is a rivet.

5. The convertible implement of claim 2 wherein said guide member is a screw.

6. The convertible implement of claim 5 wherein said receiving portion is defined by a threaded cavity in said second handle.

7. The convertible implement of claim 1 wherein said first paintbrush has a first alignment member extending outward from said first handle, and said second paintbrush has a second alignment member defined by a cavity in said second handle, said second alignment member capable of receiving said first alignment member to align first said paintbrush and said second paintbrush.

8. The convertible implement of claim 1 wherein said first bristle head is removably connected to said first handle.

9. The convertible implement of claim 8 wherein said removable connection comprises an elongated substantially trapezoidal member extending substantially perpendicularly outward from the distal end of said first handle, and a first body interconnected between said first handle and said first bristle head, said first body having a groove capable of slidingly engaging said trapezoidal member.

10. A convertible implement comprising:

a first paintbrush having a first handle and a first bristle head connected to said first handle, said first handle having a first magnetic connection member connected thereto; and a second paintbrush having a second handle and a second bristle head connected to said second handle, said second handle having a second magnetic connection member connected thereto, and wherein said second paintbrush is separably connected to said first paintbrush.

11. The convertible implement of claim 10 wherein said separable connection comprises a perforated line between said first handle and said second handle.

* * * * *